US008863470B2

(12) United States Patent
Bottorff et al.

(10) Patent No.: US 8,863,470 B2
(45) Date of Patent: Oct. 21, 2014

(54) MOLDING/TRIM QUICK RELEASE SYSTEM

(76) Inventors: Martin Lamont Bottorff, Maybee, MI (US); Thomas Walther Bottorff, Flat Rock, MI (US)

( * ) Notice: Subject to any disclaimer, the term of this patent is extended or adjusted under 35 U.S.C. 154(b) by 0 days.

(21) Appl. No.: 13/459,229

(22) Filed: Apr. 29, 2012

(65) Prior Publication Data

US 2012/0272610 A1 Nov. 1, 2012

Related U.S. Application Data

(60) Provisional application No. 61/480,559, filed on Apr. 29, 2011.

(51) Int. Cl.
*E04C 2/38* (2006.01)

(52) U.S. Cl.
USPC ..... 52/718.02; 52/718.04

(58) Field of Classification Search
USPC ..... 52/718.02, 718.04, 716.5, 718.01, 52/716.6; 411/389, 401
See application file for complete search history.

(56) References Cited

U.S. PATENT DOCUMENTS

| | | | | | |
|---|---|---|---|---|---|
| 1,389,758 | A | * | 9/1921 | Holmes | 24/694 |
| 2,309,307 | A | * | 1/1943 | Geiger | 403/116 |
| 3,037,799 | A | * | 6/1962 | Mulac | 285/282 |
| 3,153,468 | A | * | 10/1964 | Sweeney | 52/716.5 |
| 3,230,652 | A | * | 1/1966 | McNair | 40/622 |
| 3,751,785 | A | | 8/1973 | Whitesell | |
| 3,916,756 | A | * | 11/1975 | Yoda | 24/682.1 |
| 4,176,428 | A | * | 12/1979 | Kimura | 24/326 |
| 4,408,372 | A | * | 10/1983 | Kimura et al. | 24/662 |
| 5,467,571 | A | | 11/1995 | Khatibi | |
| 5,752,356 | A | | 5/1998 | Miklavic et al. | |
| 5,941,046 | A | | 8/1999 | Prather | |
| 6,629,335 | B1 | * | 10/2003 | Derman | 16/85 |
| 7,367,098 | B2 | | 5/2008 | Wang | |
| 2001/0003872 | A1 | * | 6/2001 | Pederson | 33/758 |

* cited by examiner

*Primary Examiner* — Basil Katcheves
(74) *Attorney, Agent, or Firm* — MacMillan, Sobanski & Todd, LLC

(57) ABSTRACT

A molding/trim quick release system reduces the work and materials involved to refinish walls, ceilings, or molding/trim without any of the issues previously associated with the process. The system of the present invention provides an easy way to attach and remove molding/trim so that walls, ceilings, molding/trim and the like can be refinished or renovated without issues for surrounding surfaces. Unlike conventional molding/trim, which is usually attached with nails or other fasteners and is difficult to remove, molding/trim attached with the system of the present invention may be readily removed and reattached.

7 Claims, 3 Drawing Sheets

MOLDING/TRIM QUICK RELEASE SYSTEM

CROSS-REFERENCE TO RELATED APPLICATIONS

This application claims the benefit of priority of U.S. provisional patent application No. 61/480,559, filed Apr. 29, 2011, the contents of which are herein incorporated by reference.

BACKGROUND OF THE INVENTION

The present invention relates to building methods and devices, and more particularly, to methods and devices for attaching and removing molding/trim so that walls, ceilings, or the molding/trim itself, can be refinished without issues for surrounding surfaces.

Since the beginning, molding/trim has been attached to a surface using nails, screws or bolts. This process has remained unchanged right up to the modern day. All previous methods for attaching molding/trim to a surface are permanent in nature, requiring a great deal of time, labor and expense to remove for refinishing or renovation. Refinishing the walls, ceiling or even the molding/trim itself creates issues such as paint on the adjacent surface by platter, drips, overlap, and the like.

There have been many tools developed over the years to overcome these issues, some of which worked well, but none that have worked well enough to remain in the market place. One possible exception is masking tape, which also has issues associated with its use such as it is time consuming to apply, additional cost for the tape itself and the time to remove it and then dispose of the waste, since masking tape can only be used once.

As can be seen, there is a need for an improved system for attaching and removing molding/trim.

SUMMARY OF THE INVENTION

In one aspect of the present invention, a molding/trim quick release system comprise a ball head screw adapted to attach to either a molding/trim material or a wall; a socket adapted to attach to either the molding/trim material or wall, whichever does not have the ball head screw attached thereto, wherein the socket is adapted to receive the ball head screw to removably retain the molding/trim on the wall.

In another aspect of the present invention, a molding/trim quick release system comprises a ball head screw adapted to attach to a molding/trim material; a socket adapted to attach to a wall, wherein the socket is adapted to receive the ball head screw to removably retain the molding/trim on the wall; and the socket is one of a drywall socket, adapted to secure to drywall, and a wood insert socket, adapted to secure to a wooden material.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a molding/trim quick release system that reduces the work and materials involved to refinish walls, ceilings, or molding/trim without any of the issues previously associated with the process. The system of the present invention provides an easy way to attach and remove molding/trim so that walls, ceilings, molding/trim and the like can be refinished or renovated without issues for surrounding surfaces. Unlike conventional molding/trim, which is usually attached with nails or other fasteners and is difficult to remove, molding/trim attached with the system of the present invention may be readily removed and reattached.

Figure 1:
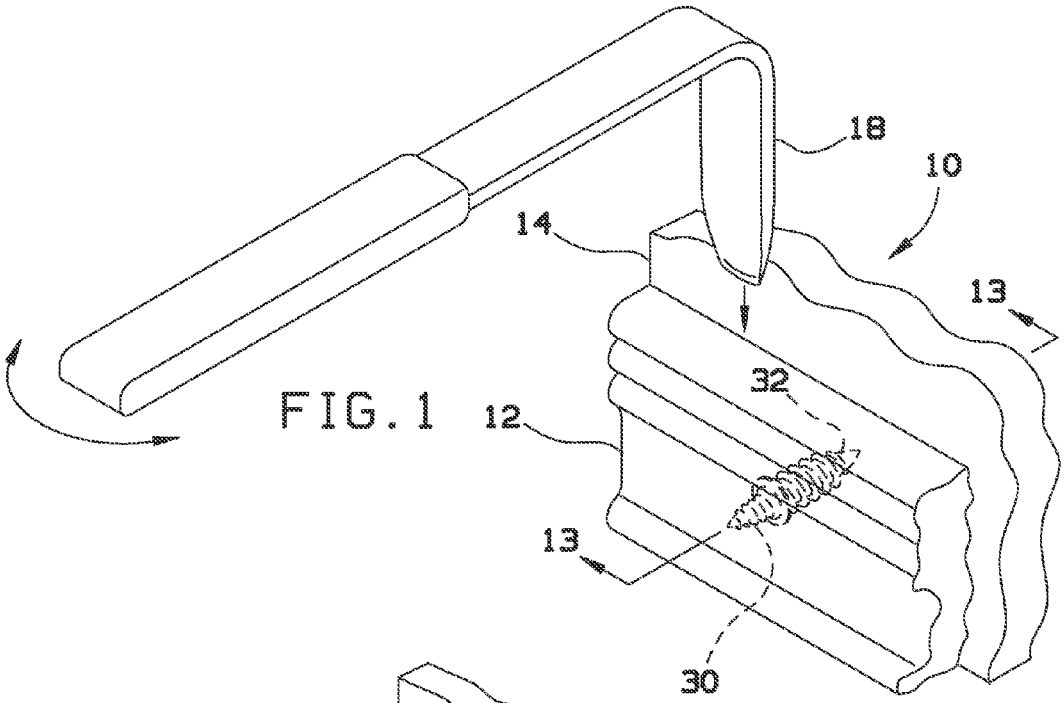
FIG. 1 is a perspective view of a molding/trim quick release system, in use, according to an exemplary embodiment of the present invention.

Referring to FIGS. 1 through 9, a quick release system 10 allows molding 12 (as used herein, molding includes molding, trim or similar materials) to easily be removed and reattached to a wall 14. A quick release tool 18 may be provided to wedge between the molding 12 and the wall 14 to remove the molding 12 from the wall 14 via the quick release system 10. A ball head screw 30 and a drywall socket 32 may be used to secure the molding 12 to the wall 14 as shown in FIG. 1.

Figure 2:
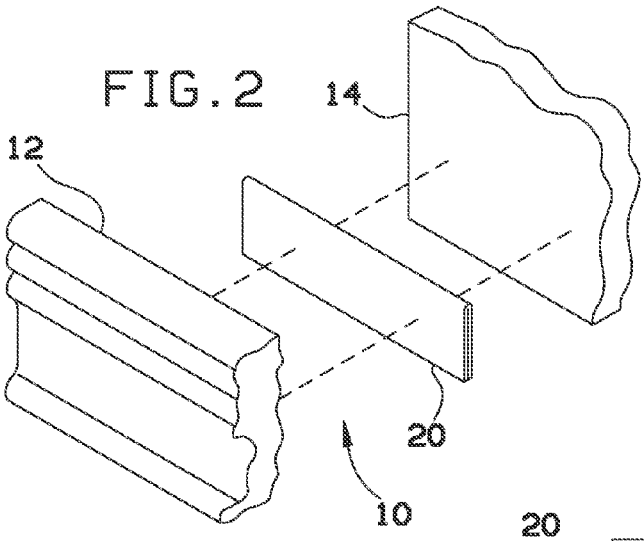
FIG. 2 is an exploded perspective view of the molding/trim quick release system of FIG. 1.
Figure 3:
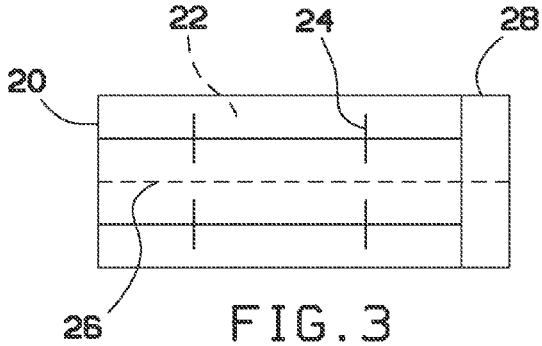
FIG. 3 is a detailed view of the molding/trim quick release system of FIG. 1, showing transfer tape unfolded.

Transfer tape 20, as shown in FIGS. 2 and 3, may be used to easily and precisely mark the locations where the ball head screw 30 and either the drywall socket 32 or a wood socket 34 (as described below) are to be mounted. The transfer tape 20 may be made of paper on one side and glue on the other side, with a removable protective covering 22 on the glued side, which can extend just beyond the glued paper to provide a transfer tape backing tab 28 for easy removal. The paper side is marked using ink, with centered cross hairs 24, and is micro-perforated 26 down the length of the center to provide easy tear away after being installed. As shown in FIG. 2, a user may apply a folded transfer tape 20 to either the wall 14 or the molding 12. The molding 12 is then applied to its desired position on the wall 14, causing the other side of the transfer tape 20 to stick. The molding 12 can then be pulled away, tearing the tape along the perforation 26 and providing the cross hairs 24 aligned on the wall 14 and the molding 12.

Figure 5:
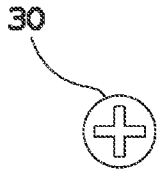
FIG. 5 is a front view of the ball head screw of FIG. 4.
Figure 6:
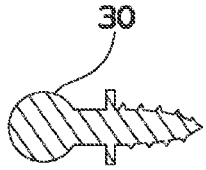
FIG. 6 is a cross-sectional view taken along line 6-6 of FIG. 4.
Figure 4:
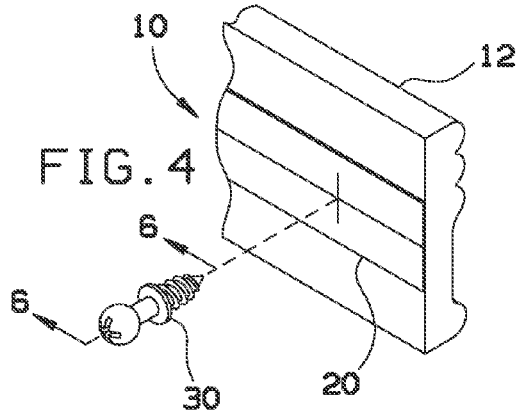
FIG. 4 is a detailed, exploded view showing a ball head screw of the molding/trim quick release system of FIG. 1.

The ball head screw 30 is shown in detail in FIGS. 4 through 6. The ball head screw 30 may be adapted to be screwed into the molding 12. When the transfer tape 20, described above, is used, the ball head screw 30 may be screwed into the molding 12 at the cross hairs 24.

Figure 7:
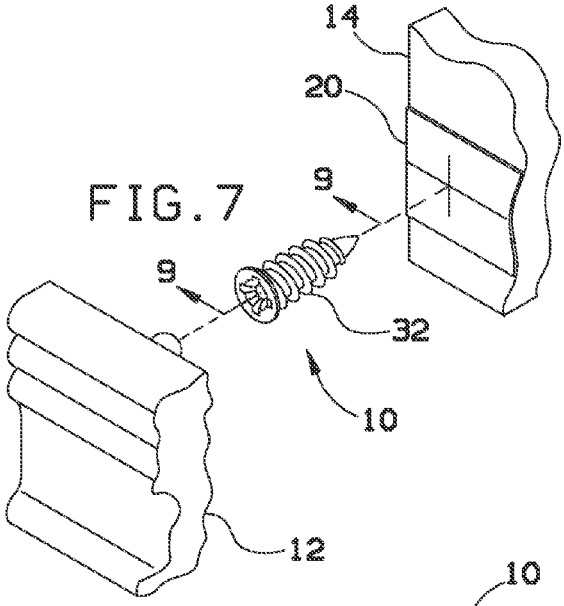
FIG. 7 is a detailed, exploded view showing a socket head screw of the molding/trim quick release system of FIG. 1.
Figure 8:
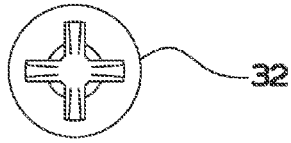
FIG. 8 is a front view of the socket head screw of FIG. 7.
Figure 9:
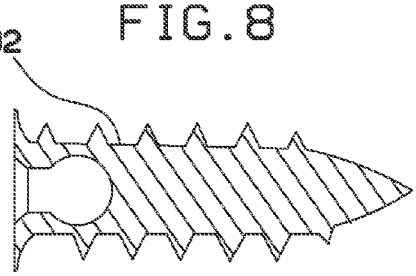
FIG. 9 is a cross-sectional view taken along line 9-9 of FIG. 7.

The drywall socket 32 is shown in greater detail in FIGS. 7 through 9. The drywall socket 32 may be adapted to attach to the wall 14, typically a drywall wall. The drywall socket 32 may screw into the drywall wall 14. When the transfer tape 20, described above, is used, the drywall socket 32 may be screwed into the drywall wall 14 at the cross hairs 24. The drywall socket 32 may interconnect to the ball head screw 30 to secure the ball head screw 30 within the drywall socket 32. In some embodiments, the drywall socket 32 may receive the ball head screw 30 to lock the molding 12 in place on the wall 14. However, while this locking engagement may be strong enough to secure the molding 12 to the wall 14, the attachment may be removable, such as with the release tool 18 shown in FIG. 1. Other similar types of release tools may be used to separate the molding 12 from the wall 14.

Both the drywall socket 32 and the ball head screw 30 may have shoulders to control the depth of the drywall socket 32 in the wall 14 and the ball head screw 30 in the molding 12. This depth control may, when the molding 12 is attached to the wall 14 through the drywall socket 32 and the ball head screw 30, provide a snug connection of the molding 12 against the wall 14.

Figure 10:
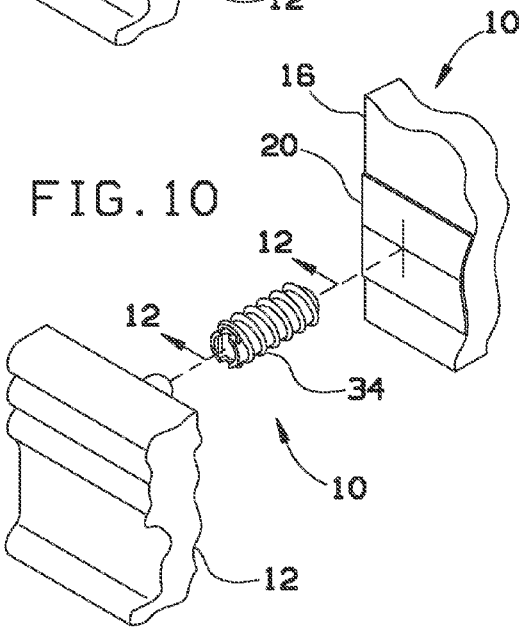
FIG. 10 is a detailed, exploded view of a wood insert socket used in the molding/trim quick release system according to an alternate embodiment of the present invention.
Figure 11:
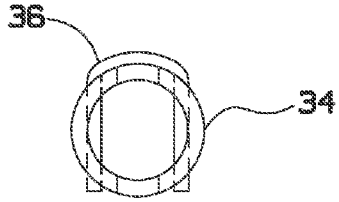
FIG. 11 is a front view of the wood insert socket of FIG. 10.
Figure 12:
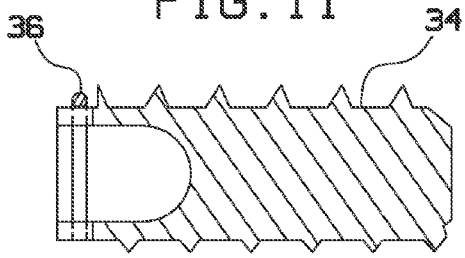
FIG. 12 is a cross-sectional view taken along line 12-12 of FIG. 10.
Figure 13:
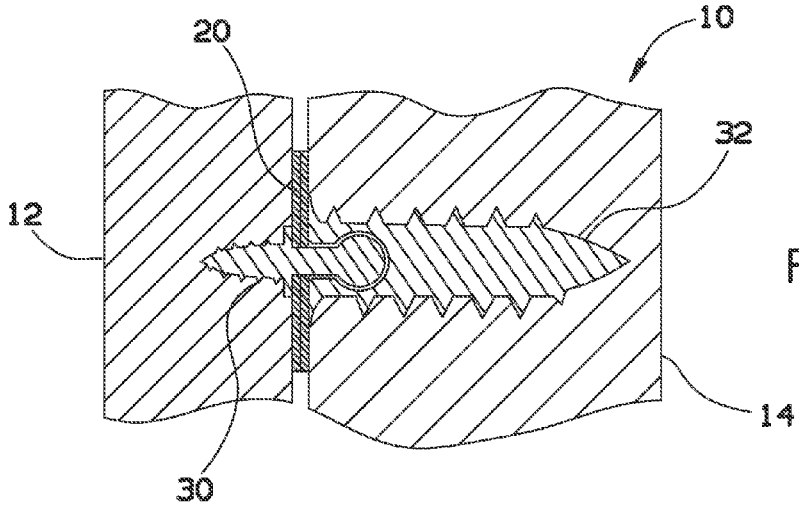
FIG. 13 is a cross-sectional view taken along line 13-13 of FIG. 1.
Figure 14:
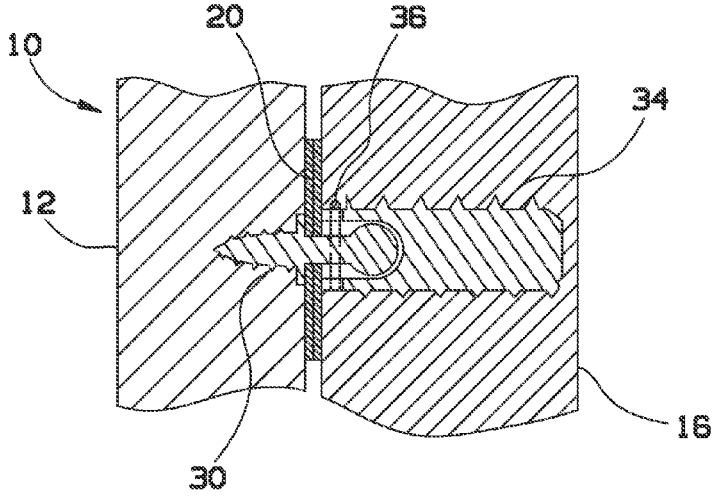
FIG. 14 is a cross-sectional view of a molding/trim quick release system according to an alternate embodiment of the present invention.

Referring to FIGS. 10 through 12, when the wall is a wooden panel 16, the wood insert socket 34 may be used. The wood insert socket 34 may provide a stable socket mount for the ball head screw 30. The wood insert socket 34 can screw into the wooden panel 16 where no drywall or other such material is present, or into drywall where there are studs or other such wood beneath the surface. The body of the wood insert socket 34 is threaded along its length, with slots cut into the socket end for easily installing using a screwdriver. Two holes may be drilled near the end of the wood insert socket 34 to accept a spring steel wire 36 that can form a spring type lock.

The drywall socket 32 can be made from various materials, such as injection molded plastic. The wood insert socket 34 may be machined from metal, such as brass or steel, with the spring steel wire 36 inserted in the top portion. The ball head screw 30 may be machined from metal, such as steel. The quick release tool 18 may be made from flat stock metal, such as stainless steel. The transfer tape 20 may be made of paper, glue and a protective peel off backing.

In an exemplary embodiment, to use the system 10 of the present invention, a person would first cut their molding/trim 12 to size then affix the transfer tape 20 to the desired mounting points on the molding/trim 12 then set the molding/trim 12 into place, allowing transfer tape 20 to stick to both wall 14, 16 and the molding/trim 12. The molding/trim 12 can then be removed, leaving half of the transfer tape 20 on the wall 14, 16 and the other half on the molding/trim 12.

With transfer tape 20 securely in place, one can now mount the ball head screw 30 onto the molding/trim 12 and mount either the dry wall socket 32 or the wood insert socket 34 into the wall structure 14, 16. The molding/trim 12 now can be mounted to the structure and locked into place through the ball and socket action of the fasteners 30 and 32 or 34. When the molding/trim 12 removal is desired, the quick release tool 18 can be slipped behind the molding/trim 12, near the socket 32 or 34 and ball head screw 30, and, with lateral movement to the left or right, can dislodge the ball head screw 30 from either the drywall socket 32 or the wood insert 34, whichever one was used.

While the above discusses using the ball and socket connection system for molding or trim or the like, the present invention may have other applications. For example, the ball head screw 30 and the socket inserts 32, 34 could be reconfigured for other uses such as mounting shelves, pictures, wall decor, and the like.

While the above configuration assigns the ball head screw to the molding/trim 12 and the socket 32, 34 to the wall, this configuration could be reversed. In the reversed embodiment, the ball head design could be made as a drywall ball head screw or a wood ball head screw and a socket may be designed to attach to the molding/trim 12.

It should be understood, of course, that the foregoing relates to exemplary embodiments of the invention and that modifications may be made without departing from the spirit and scope of the invention as set forth in the following claims.

Thus, the molding/trim quick release system of this invention includes (1) a ball head screw adapted to attach to either a molding/trim material or a wall, the ball head screw defining a longitudinal axis and including a head portion that is generally circular in cross sectional shape when viewed perpendicularly to the longitudinal axis of the ball head screw; and (2) a socket adapted to attach to either the molding/trim material or the wall, whichever does not have the ball head screw attached thereto, the socket defining a longitudinal axis and including a receiving portion that is generally circular in cross sectional shape when viewed perpendicularly to the longitudinal axis of the socket. The receiving portion of the socket receives the head portion of the ball head screw to removably retain the ball head screw on the socket. The ball head screw includes an externally threaded shank portion and a shoulder that is disposed between the head portion and the externally threaded shank portion, and the socket includes an externally threaded shank portion and a shoulder that is disposed adjacent to the externally threaded shank portion.

The molding/trim quick release system of this invention also includes (1) a ball head screw adapted to attach to either a molding/trim material or a wall, the ball head screw defining a longitudinal axis and including a head portion that defines a first dimension when viewed in the direction of the longitudinal axis of the ball head screw; (2) a socket adapted to attach to either the molding/trim material or the wall, whichever does not have the ball head screw attached thereto, the socket defining a longitudinal axis and including a receiving portion that defines a second dimension when viewed in the direction of the longitudinal axis of the socket that is larger than the first dimension, the receiving portion of the socket receiving the head portion of the ball head screw; and (3) a clip having portions that extend through the receiving portion of the socket, the portions of the clip that extend through the receiving portion of the socket defining a third dimension when viewed in the direction of the longitudinal axis of the ball head screw that is smaller than the first dimension to removably retain the head portion of the ball head screw in the receiving portion of the socket.

Lastly, the molding/trim quick release system of this invention includes (1) a transfer tape including a first portion and a second portion that are separated by a perforation, the first portion of the transfer tape having cross hairs provided thereon, the second portion of the transfer tape having cross hairs provided thereon that are aligned with the cross hairs provided on the first portion of the transfer tape; (2) a ball head screw extending through the cross hairs provided on the first portion of the transfer tape and attached to a first one of a molding/trim material or a wall, the ball head screw defining a longitudinal axis and including a head portion; and (3) a socket extending through the cross hairs provided on the second portion of the transfer tape and attached to a second one of the molding/trim material or the wall, whichever does not have the ball head screw attached thereto, the socket defining a longitudinal axis and including a receiving portion, the receiving portion of the socket receiving the head portion of the ball head screw.

What is claimed is:

1. A quick release system for securing a molding to a wall comprising:

a ball head screw attached to either a molding or a wall, the ball head screw defining a longitudinal axis and including a head portion that defines a first dimension when viewed in the direction of the longitudinal axis of the ball head screw;

a socket attached to the other of the molding or the wall, whichever does not have the ball head screw attached thereto, the socket being cylindrical in shape and defining a longitudinal axis, the socket including a receiving portion that defines a second dimension when viewed in the direction of the longitudinal axis of the socket that is larger than the first dimension, the receiving portion of the socket receiving the head portion of the ball head screw and having a thread provided on an outer surface thereof that attaches the socket to the other of the molding or the wall; and a clip having portions that extend through the receiving portion of the socket, the portions of the clip that extend through the receiving portion of the socket defining a third dimension when viewed in the direction of the longitudinal axis of the ball head screw that is smaller than the first dimension to removably retain the head portion of the ball head screw in the receiving portion of the socket.

2. The molding/trim quick release system defined in claim 1 wherein the clip is a spring clip.

3. The molding/trim quick release system defined in claim 1 wherein the clip is a spring steel clip.

4. The molding/trim quick release system defined in claim 1 wherein the ball head screw includes an externally threaded shank portion and a shoulder that is disposed between the head portion and the externally threaded shank portion.

5. The molding/trim quick release system defined in claim 1 wherein the portions of the clip that extend through the receiving portion of the socket engage the head portion of the ball head screw within the receiving portion of the socket so as to removably retain the head portion of the ball head screw within the receiving portion of the socket.

6. The molding/trim quick release system defined in claim 1 wherein the portions of the clip that extend through the receiving portion of the socket removably retain the head portion of the ball head screw within the receiving portion of the socket without changing the second dimension.

7. The molding/trim quick release system defined in claim 1 wherein the receiving portion of the socket is a hollow interior portion of the socket, and wherein the second dimension is an interior dimension defined by the hollow interior portion of the socket.

* * * * *